United States Patent [19]

Downey

[11] Patent Number: 4,947,729

[45] Date of Patent: Aug. 14, 1990

[54] SPIN STABILIZING GUN

[76] Inventor: Timothy Downey, 4310 Sinnwell Dr., St. Louis, Mo. 63123

[21] Appl. No.: 367,551

[22] Filed: Jun. 19, 1989

[51] Int. Cl.[5] ..... F41A 21/36

[52] U.S. Cl. ..... 89/14.3

[58] Field of Search ..... 42/78, 79; 89/14.2, 89/14.3

[56] References Cited

U.S. PATENT DOCUMENTS 2,184,301 12/1939 Hughes .
2,184,595 12/1939 Hughes .
2,451,514 10/1948 Sieg .
2,742,821 4/1956 Sweetman .
3,202,056 8/1965 Seeberger .

FOREIGN PATENT DOCUMENTS 578369 6/1958 Italy ..... 89/14.3

OTHER PUBLICATIONS

Neue Zuricher Zeitung, Gliksman, 9/29/43, Reprinted from the Journal of the Royal Artillery.

*Primary Examiner*—Charles T. Jordan
*Assistant Examiner*—Richard W. Wendtland
*Attorney, Agent, or Firm*—Rogers, Howell & Haferkamp

[57] ABSTRACT

An attachment for a gun has a plurality of pressure relief ports positioned on the barrel that create pressure differentials which impart a rotary motion to the projectile which stabilize the projectile in its ballistic path. The pressure relief ports allow the gun to spin stabilize the projectile without the provision of rifling in the barrel. The pressure relief ports can further be arranged to reduce recoil and barrel rise associated with firing the gun.

8 Claims, 1 Drawing Sheet

FIG. 1.
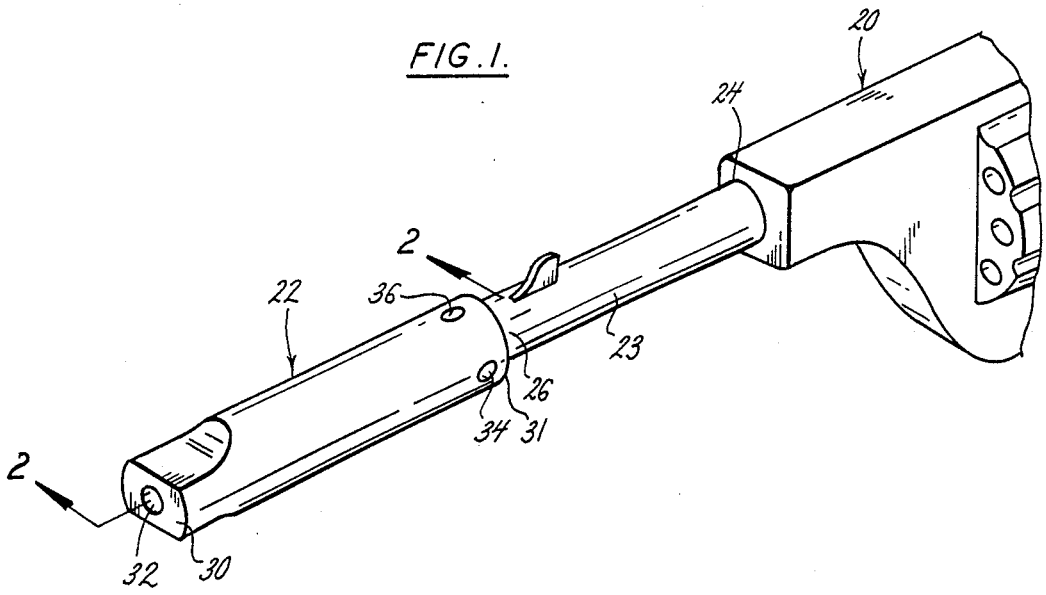
FIG. 2.
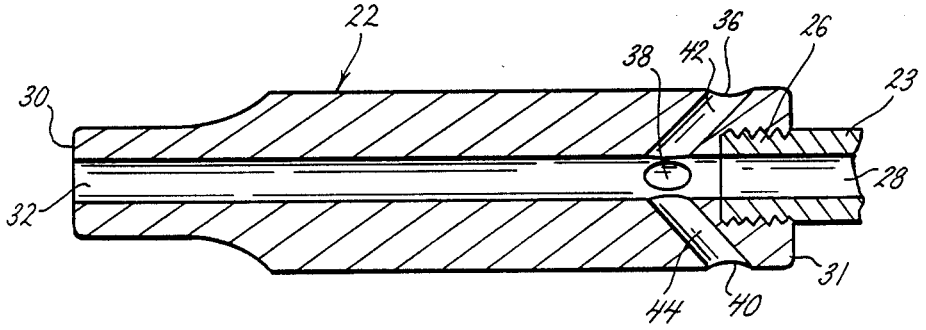
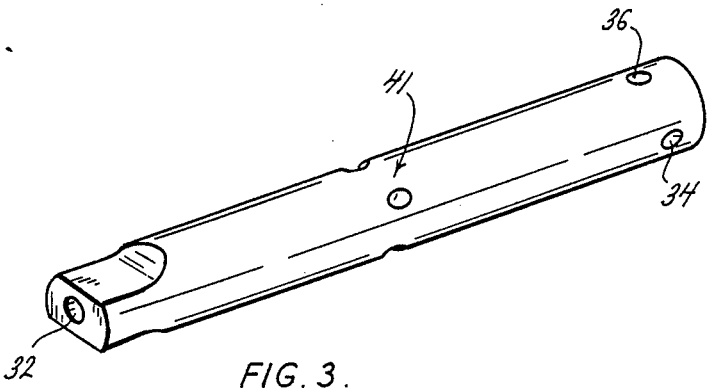
FIG. 3.

SPIN STABILIZING GUN

BACKGROUND OF THE INVENTION

This invention relates to the art of gunnery and more particularly to certain improvements therein whereby the speed of a projectile fired from a gun can be increased, the projectile can be spin-stabilized and recoil and barrel rise of the gun can be reduced.

Gunpowder was discovered by the Chinese in the middle of the ninth century and was first used in fireworks. There are accounts from the late eleventh century of projectileless guns that hurled flaming gun powder and debris. By the fourteenth century, projectile-firing guns were in use. This was the start of a long evolution that brought about dramatic increases in the reliability of guns and in the speed and accuracy of projectiles.

One of the most important developments in the art of gunnery was rifling. Named from the German word riffeln, to groove, rifling consists of a series of longitudinal spiral grooves on the inner surface of the gun barrel designed to impart a spin to the projectile.

The drill-like spin imparted to the projectile results in several advantages: The gyroscopic spin equalizes irregularities in the projectile's flight, lessening its tendency to depart from a straight line. The spin eliminates the tumbling of the projectile, permitting aerodynamic pointed-nose projectiles to replace the spherical projectiles previously used. The pointed projectiles, having less air resistance, have greater speed and accuracy. The increased speed results in greater range and deeper penetration on impact. The drilling action of the spinning projectile also results in deeper penetration.

The spin-causing rifling, however, also has several disadvantages. The spin is imparted to the projectile through frictional contact with the lands, the non-relieved portion of the barrel interior. This friction reduces the energy and speed of the bullet. This reduction in energy diminishes the range and penetration of the projectile. The friction between the projectile and the gun barrel also causes the gun barrel to heat up. This poses a hazard to the operator. Often some cumbersome insulation means must be provided for the gun barrel to protect the operator. Moreover, even greater accuracy, of course, is also desired. Finally, the tight fit of the projectile in the gun barrel causes a high pressure build up in the barrel behind the projectile. The release of this pressure produces a recoil than can injure the operator and ruin aim in repeated firing. A related problem is barrel rise: after firing, the barrel of a gun tends to rise. This action ruins aim in repeated firing.

The improvements of this invention comprise a plurality of pressure relief means positioned on an attachment for the barrel of the gun. These pressure relief means are circumferentially spaced to create pressure differentials as the projectile passes through the barrel. These pressure differentials impart a rotary motion or spin to the projectile thereby spin-stabilizing the projectile without frictional contact between the projectile and the gun barrel. It is further a part of this invention to orient these pressure relief means rearwardly and outwardly to reduce recoil and barrel rise in the gun.

The improvements of this invention cause the gun to impart a substantial spin to the projectile and to increase the speed of the projectile without the disadvantages of rifling. This invention reduces the frictional contact between the projectile and the gun barrel thereby eliminating the reduction in the energy of the projectile and the subsequent reduction in projectile speed, range and penetration. Frictional heating of the gun barrel is also reduced.

The improvements of this invention are of simple operation. They are easily and inexpensively incorporated into new guns as well as retrofit to existing guns. Furthermore, they can be incorporated so as to additionally reduce recoil and barrel jump associated with the firing of a gun.

BRIEF DESCRIPTION OF THE DRAWINGS

FIG. 1 is a partial perspective view of a gun having an attachment constructed according to the principles of this invention;

FIG. 2 is a view taken along line 2—2 of FIG. 1, of a gun barrel and attachment constructed according to the principles of this invention; and FIG. 3 is a partial perspective view of a second embodiment of the attachment of this invention for large guns.

DESCRIPTION OF THE PREFERRED EMBODIMENT

Referring to the drawings, FIG. 1 shows a handgun 20 having an attachment 22 constructed according to the principles of this invention, which apply to any projectile firing apparatus that fires a projectile through a barrel.

As best seen in FIG. 2, attachment 22 is attached to barrel 23, which is a standard barrel in that it has a breach end 24 (not seen in FIG. 2), a muzzle end 26, and a bore 28 running therebetween. However, the muzzle end 26 of barrel 23 is threaded for receiving attachment 22. Attachment 22 has a muzzle end 30, a breach end 31 that is threaded for engagement with muzzle end 26 of barrel 23, and a bore 32 running therebetween. Alternatively, the attachment of this invention may be fixed to a standard unthreaded barrel with set screws directed angularly inwardly from the attachment to the barrel. Preferably, the set screws would extend at an angle of about 60° from the axis of the barrel, with the tips of the screws directed forwardly. Bore 32 of attachment 22 is of about the same diameter as bore 28 of barrel 23. The muzzle end of the attachment 22 may be shaped so that a wrench may be used to grip the attachment for tightening the attachment onto the gun barrel.

Attachment 22 has four ports 34, 36, 38 and 40 in the outer surface of the barrel and extending inwardly through to bore 32. The ports are symmetrically circumferentially spaced about the barrel near the breach end 31 of attachment 22.

Beside the threading, barrel 23 may also differ from a standard barrel in that bore 28 is not rifled, but its diameter is sized about the same as that of the barrel 23. Preferably, before firing, the diameter of the barrel 23 and bore 28 are about the same as the diameter of the projectile to be fired through them.

Ports 34, 36, 38 and 40 are sized at approximately pi times one-quarter of the diameter of the projectile to be fired through bore 32. Channels 42 and 44 initiate at ports 36 and 40, respectively, and extend generally inwardly and forwardly from the outer surface of attachment 22 to bore 32, preferably at an angle of about 45°. Thus, from a point of view inside the bore 32, the channels extend generally outwardly and rearwardly. That is, the channels initiating at the ports and extending to bore 32 are inclined so that they meet bore 32 at a position nearer muzzle end 30 than are the ports. It has been found that the optimal incline for the channels is about 45° from the axis of bore 32. Preferably, the channels meet the bore at a point as close to the muzzle as possible. Thus, as shown in FIG. 2, the ports on the outer surface of the attachment may actually be located behind the muzzle opening of the gun barrel.

The attachment should be long enough to provide effective projectile stabilization. Generally, the attachment should add about 25% to the length of the barrel, and with respect to small calibers, attachments of about 4 inches in length (including the threaded portion which overlaps the muzzle of the gun barrel) are acceptable. The attachment may be formed of any standard material, such as carbon steel or low grade tool steel.

The arrangement of ports described applies to any projectile firing apparatus that fires a projectile through a barrel, including pistols, rifles and cannons. However, for larger apparatus such as cannons, more than one set of ports might be employed. In other words, as shown in FIG. 3, a second set 41 of four ports about the attachment may be longitudinally spaced from the first set. The second set should be angularly oriented about 45° from the first set so that the ports are staggered.

The following example illustrates the invention.

EXAMPLE

The advantages of this invention are best illustrated by the following test results between a rifle with and without the attachment. The average velocity of a projectile fired from an AR-15 carbine rifle with a sixteen-inch barrel was measured at 2950 feet per second. The average velocity of a projectile fired from the same rifle with an attachment as illustrated in the FIGS. 1 and 2 herein was measured at 3280 feet per second. The second projectile penetrated 3/8 inch carbon steel.

Operation

As a projectile is fired through the barrel, a substantial pressure created behind the projectile drives it forward through bore 28 in barrel 23 from the breach end 24 to the muzzle end 26, and likewise through the bore 32 in the attachment 22 from the breach end 31 to the muzzle end 30 of the attachment 22. As the rear of the projectile passes ports 34, 36, 38 and 40, part of the pressure behind the projectile is released, creating a localized zone of low pressure which alters the flight of the projectile. Although not wishing to be bound to any particular theory, it is believed that the net effect of the localized zone of low pressure is to impart a rotary motion or spin to the projectile and to draw a portion of the expanding gases in the rearward portion of the barrel forward toward the muzzle end. These gases contain burning gun powder particles that regenerate or increase in the rate of burning. In fact, what is believed to be a second explosion within the barrel has been discerned.

It has been found that the full advantages of this invention are not realized with less than four ports. In particular, two ports have been found not to provide significant velocity increase, while three or five ports do not improve accuracy as desired. Likewise, six ports in a longitudinally staggered orientation leads to relatively inaccurate aim. Additional ports weaken the attachment. Thus, four ports have been found to be optimal. Moreover, it is particularly desirable that the ports be spaced at 90° intervals, with one port at the top surface of the barrel when the gun is held in the standard firing position (see port 36 in FIG. 1).

Because of the outward and rearward orientation (as viewed from inside the bore 32) of channels 42 and 44 and the corresponding channels extending from ports 34 and 38, pressure escaping from ports 34, 36, 38 and 40 is channeled outward and rearward to counteract the recoil forces normally encountered in firing a gun. It has been found that the channels should extend at an angle of about 45° from the central or longitudinal axis of the barrel in order to obtain optimal results.

Presumably because one of ports 34, 36, 38 and 40 (port 36 as shown in the FIGURES) is on the top surface of the attachment 22 (that is a part of the attachment surface visible from a top plan view), escaping pressure from this port counteracts the upward motion or barrel rise normally found in firing a gun. The spin imparted to the projectile creates a pressure zone between the barrel and the projectile which prevents frictional contact between the projectile and the barrel. Since the localized zone of low pressure impart a rotary motion or spin to the projectile, such frictional contact with the barrel is no longer necessary. Surprisingly, the attachment of this invention has also been found to improve the accuracy of projectiles fired from gun equiped with the attachment. The attachment is also advantageous in that it serves to hide the flash of gun powder emitted from the gun during firing.

Although the invention is useful as an attachments for retrofitting standard firearms, it is also contemplated that standard firearms may also be adapted by the boring of ports directly into the barrel.

There are various changes and modifications which may be made to the invention as would be apparent to those skilled in the art. However, these changes or modifications are included in the teaching of the disclosure, and it is intended that the invention be limited only by the scope of the claims appended hereto.

I claim:

1. For an apparatus for firing a projectile having a barrel with a breach end and a muzzle end through which the projectile passes, an attachment for securing to the breach end, said attachment having a bore therethrough to form an extension of the barrel of the apparatus and comprising a means for spin-stabilizing the projectile comprising a plurality of pressure relief means circumferentially and symmetrically spaced about the bore, the plurality of pressure relief means being a series of 4 ports, at least one of which is located on the top surface of the attachment, the diameter of each port being approximately pi times one-quarter of the inside diameter of the barrel.

2. The attachment of claim 1 wherein, for each port, a channel extends outwardly and rearwardly from the bore to the port.

3. The attachment of claim 2 wherein each channel is inclined about 45° from the central axis of the bore.

4. In an apparatus for firing a projectile having a barrel with a breach end and a muzzle end through which the projectile passes, a means for spin-stabilizing the projectile comprising four pressure relief ports circumferentially spaced about the barrel, one of the pressure relief ports being on the top surface of the barrel, the diameter of each port being approximately pi times one-quarter of the inside diameter of the barrel.

5. The means for spin-stabilizing a projectile of claim 4 wherein the ports of each pair of pressure relief means are symmetrically circumferentially spaced about the barrel.

6. The means for spin-stabilizing a projectile of claim 5 wherein, for each port, a channel extend outwardly and rearwardly from the interior of the barrel to the port.

7. The means for spin-stabilizing a projectile of claim 6 wherein each channel is inclined about 45° from the central axis of the barrel.

8. The means for spin stabilizing a projectile of claim 7 wherein there is more than one set of pressure relief means, the sets of pressure relief means being longitudinally spaced apart.

* * * * *